US009322237B2

(12) United States Patent
Schicker et al.

(10) Patent No.: US 9,322,237 B2
(45) Date of Patent: Apr. 26, 2016

(54) MECHANICAL FORCE GENERATOR FOR A DOWNHOLE EXCITATION APPARATUS

(75) Inventors: Owen Schicker, Timaru (NZ); Mark Christopher Cunliffe, Timaru (NZ)

(73) Assignee: FLEXIDRILL LIMITED, North Shore (NZ)

( * ) Notice: Subject to any disclaimer, the term of this patent is extended or adjusted under 35 U.S.C. 154(b) by 314 days.

(21) Appl. No.: 14/002,957

(22) PCT Filed: Feb. 26, 2012

(86) PCT No.: PCT/IB2012/050875

§ 371 (c)(1),
(2), (4) Date: Nov. 8, 2013

(87) PCT Pub. No.: WO2012/120403

PCT Pub. Date: Sep. 13, 2012

(65) Prior Publication Data

US 2014/0054090 A1 Feb. 27, 2014

Related U.S. Application Data

(60) Provisional application No. 61/449,178, filed on Mar. 4, 2011, provisional application No. 61/489,456, filed on May 24, 2011.

(30) Foreign Application Priority Data

Mar. 4, 2011 (NZ) ..... 591548
May 24, 2011 (NZ) ..... 593041

(51) Int. Cl.
*E21B 31/00* (2006.01)
*E21B 6/04* (2006.01)
(Continued)

(52) U.S. Cl.
CPC ..... *E21B 31/005* (2013.01); *E21B 4/10* (2013.01); *E21B 6/04* (2013.01); *E21B 7/24* (2013.01); *E21B 28/00* (2013.01); *E21B 31/107* (2013.01)

(58) Field of Classification Search
CPC ..... E21B 7/24; E21B 31/005; E21B 4/10; E21B 31/107; E21B 31/113; E21B 31/1135; E21B 4/14; E21B 28/00; E21B 6/04
See application file for complete search history.

(56) References Cited

U.S. PATENT DOCUMENTS 2,713,472 A * 7/1955 Bodine, Jr. ..... E21B 7/24 175/243
2,742,265 A 4/1956 Snyder
(Continued)

FOREIGN PATENT DOCUMENTS

SU 1126680 A 11/1984
WO 97/24508 A1 7/1997

OTHER PUBLICATIONS

International Search Report; PCT/IB2012/050875; Jul. 27, 2012.
(Continued)

*Primary Examiner* — Daniel P Stephenson
(74) *Attorney, Agent, or Firm* — Studebaker & Brackett PC

(57) ABSTRACT

An excitation apparatus suitable for use downhole having interengaged masses at least in part confined or guided so as to be movable as an interengaged assembly on an axis, one mass ("rotatable mass") being rotatable relative to the other mass about the axis to cyclically vary the axial length of the assembly of the interengaged masses, a rotary drive, and an interposed spring (of any kind) between the rotary drive and the rotatable mass able to transmit torque from the rotary drive to the rotatable mass yet vary in its extent responsive to the interengaged masses.

15 Claims, 10 Drawing Sheets

(51) Int. Cl.

| | |
|---|---|
| ***E21B 7/24*** | (2006.01) |
| ***E21B 4/10*** | (2006.01) |
| ***E21B 28/00*** | (2006.01) |
| ***E21B 31/107*** | (2006.01) |

(56) References Cited

U.S. PATENT DOCUMENTS

| | | | | |
|---|---|---|---|---|
| 4,502,552 | A | 3/1985 | Martini | |
| 4,667,742 | A | 5/1987 | Bodine | |
| 5,669,457 | A | 9/1997 | Sebastian et al. | |
| 5,875,842 | A | 3/1999 | Wyatt | |
| 6,047,778 | A * | 4/2000 | Coffman | E21B 4/00 173/205 |
| 6,131,672 | A * | 10/2000 | Beccu | E21B 4/14 173/17 |
| 7,708,088 | B2 * | 5/2010 | Allahar | E21B 31/005 175/55 |
| 7,882,906 | B1 | 2/2011 | DeCuir, Sr. | |
| 2005/0121231 | A1 | 6/2005 | Clayton | |
| 2008/0099245 | A1 * | 5/2008 | Hall | E21B 4/06 175/57 |
| 2013/0133909 | A1 * | 5/2013 | Greenwood | B06B 1/04 173/90 |
| 2013/0160991 | A1 * | 6/2013 | Gregory | E21B 4/02 166/177.6 |
| 2013/0168080 | A1 * | 7/2013 | Powell | E21B 4/02 166/177.6 |
| 2014/0054090 | A1 * | 2/2014 | Schicker | E21B 4/10 175/95 |
| 2014/0144705 | A1 * | 5/2014 | Baudoin | E21B 7/24 175/57 |
| 2014/0150576 | A1 * | 6/2014 | Gregory | E21B 7/24 74/56 |
| 2014/0174726 | A1 * | 6/2014 | Harrigan | E21B 31/005 166/250.01 |
| 2015/0023137 | A1 * | 1/2015 | Benson | E21B 7/06 367/82 |

OTHER PUBLICATIONS

Written Opinion of the International Search Authority; PCT/IB2012/050875; Jul. 27, 2012.

* cited by examiner

MECHANICAL FORCE GENERATOR FOR A DOWNHOLE EXCITATION APPARATUS

FIELD OF INVENTION

The present invention relates to mechanical force generators, excitation devices, downhole excitation assemblies, and the like, their usage, subassemblies thereof, related methodologies, systems and the like.

BACKGROUND

In the drilling world, and more particularly in deep horizontal intervals there is often a need to provide the drill string (whether jointed drill rods, or continuous coil tube) with a level of axial excitation to minimise the frictional forces which can dramatically slow or stop a drilling or re entry operation. In addition this type of tool would be very beneficial to have within a drill string (or multiple such devices within a drill string) to help free drill strings once they have become stuck.

Ideally such a device would have the ability to:

Be engaged as and when necessary.

Generate sufficient force to minimise friction—and/or free stuck drill strings

Allow a substantially unrestricted fluid path through the length of the tool for drilling fluids, lost circulation medium etc.

Have a controllable level of force, from gentle to strong—adjustable as required from surface.

In addition to the above the device could also be used as a seismic signal generator, or used for settling cement, or any other application where an axial excitation is useful.

It is a further or alternative object to provide an "on demand" capability downhole whereby, as and when wanted, a mechanical force generator can be activated. A further alternative is such a capability that is always or usually always operative.

The device options mentioned below aims to achieve or lend themselves to at least one or more of these objectives.

BRIEF DESCRIPTION OF THE INVENTION

In another aspect the invention is a mechanical force generator comprising or including an elongate housing of at least substantially axially extending inner and outer members, a mass in the elongate housing between the inner and outer members able to reciprocate in the axial direction yet held against any substantial rotation relative to one, or both, of said members, a rotatable member cam or otherwise indexed or otherwise interengaged ("indexed") to the mass between the inner and outer members, the rotation of the rotatable member relative to the mass able to pulse by some multiple of the input rotations(s) of the rotatable member the axial extent of that indexed assembly i.e. preferably each rotation of the rotary drive provides one or more reciprocation and/or axial excitation of the rotatable member and its indexed mass, a rotary drive to provide directly or indirectly a rotational input to the rotatable member, and optionally, any one or more, or none, of the following:

a torque transmission spring (of any kind) from the rotary drive to rotate the rotatable member to allow at least substantially longitudinal relative movement, between the rotary drive and the rotatable member.

a spring (of any kind) from a drill rod, coil tube, or the like to the elongate housing from one end [e.g. proximally], and/or a spring (of any kind) to a drill rod, coil tube, tool or the like from the elongate housing from the other end [e.g. distally].

Preferably the mass/rotatable member indexing provides for a sliding association that allows relative rotation yet controls their relative axial positioning as an assembled unit.

Preferably the device in operation has no impact percussions.

Preferably the mechanical force generator is of or for a drill string (e.g. whether jointed drill rods or continuous coil tube) to provide axial excitation.

Preferably the outer member is a tube or tubular casing.

Preferably the inner member is a tube (but less preferably can be non-tubular).

Preferably the housing is at least substantially sealed to provide an elongate annular space in which the mass, rotatable member, and rotary drive (and if present torque transmission spring) can cooperate as stated.

Most preferably the rotatable member is provided with lobes or other means whereby each rotation of the rotary drive provides two or more cycles (e.g. reciprocations) as axial excitations. In other forms a non-lobed rotatable member, but swash plate like inclined, can provide a single cycle per revolution. Alternatively any rotatable member that converts the rotary input to an axial movement.

Preferably the mass splines to the outer member.

Preferably both the mass and rotatable member are on bushes, bearings, runners or the like from the inner member.

Preferably the rotary drive is on a bearing or bush or the like from the inner member.

Preferably the rotary drive is on at least one thrust bearing from the outer member.

Preferably the spring acts as a tether between the rotary drive and the rotatable member.

Preferably the excitation pathway is from the mass/rotatable member assembly as it varies in length and/or reciprocates via the torque transmission to the rotary drive and through into the outer member.

Preferably the tethering torque transmission is or includes a resonant spring.

Optionally there is no tethering spring and the rotatable masses are substantially of a non compliant nature.

Preferably there is provision of a centre fluid path, provides a straight, uniform, uninterrupted fluid path through the generator or tool.

Optionally the fluid path is not straight, but is provided through or around the outer casing.

Preferably where any components that are in contact with the bore fluid, then such components are constructed with acid resistant materials (e.g. Inconel, Monel etc)

Optionally an annulus (but not the fluid path) may—or may not be filled with a non compressible fluid.

Optionally there may be a vibration isolation member (spring/spline/air bag/or any other compliant member) either above—or below the tool to minimise unwanted vibration in either the up hole—or down hole direction.

Optionally any vibrational off take may be in either the up hole—or downhole direction or both.

Optionally the output power/force can be manipulated by controlling the input drive RPM (whether by fluid flow or other means).

Preferably the apparatus can be used anywhere in the drill string (e.g. the top—middle or end) and multiple units can be used within the drill string.

Optionally the apparatus can be used in conjunction with diverter valves (whether fluid or gas etc) which can be used to engage/disengage the device through interrupting the input drive.

Optionally the compliant member (s) spring etc) may be anywhere within the assembly.

Optionally any/all bearings within the device may be protected from any detrimental force by a compliant member (s) (springs—air bags, elastomers etc)

In another aspect the invention is an excitation apparatus comprising or including interengaged masses at least in part confined or guided so as to be movable as an interengaged assembly on an axis, one mass ("rotatable mass") being rotatable relative to the other mass about the axis to cyclically vary the axial length of the assembly of the interengaged masses, a rotary drive, and an interposed spring (of any kind) between the rotary drive and the rotatable mass able to transmit torque from the rotary drive to the rotatable mass yet vary in its extent responsive to the interengaged masses.

Preferably the rotary drive is on the pathway for excitation transmission via the spring from the interengaged masses.

Preferably the interengaged masses has one mass splined to a confinement casing and the rotatable mass is rotatable about an internal elongate member on which the interengaged masses are axially guided.

In another aspect the invention is an excitation device reliant on a selective rotary drive through a resilient extendible/contractable torque drive tether into a reciprocable shuttle assembly that itself varies in overall length during shuttling, the shuttle assembly having a mass to reciprocate axially of the axis of the rotary drive and a rotatable member tethered by the torque drive tether.

Preferably, at non-resonant operation, rotation of the rotatable member under transmitted torque cams the non-rotating mass thereby to vary the overall length of the shuttle assembly, and, at resonant operation or near resonant operation, the extendible/contractable tether exerts a greater control on the mean positions of the shuttle assembly relative to the rotary drive.

Preferably the excitation outflow is via the tether and rotary drive into a casing (e.g. via a thrust bearing).

In another aspect the invention is the use, in a casing or drillstring, of a mass (non-rotatable relative to the casing) indexed to a rotatable cam (rotatable relative to the casing) as a shuttle assembly, able:

(i) to increase and decrease in axial extent as the rotating cam interacts with the follower of the mass, and (ii) to receive torque to rotate the rotatable cam from an extendible/contractable tether from the rotary input.

Preferably the use is to provide an excitation axially of the casing (preferably via the tether into the casing through the rotary input).

In another aspect the invention is a mechanical force generator comprising or including an elongate housing of at least substantially longitudinally extending inner and outer members, the outer member being a tube a mass, shuttle or piston ("piston") in the elongate housing between the inner and outer members able to reciprocate in the longitudinal direction yet held against any substantial rotation relative to one, or both, of said members, a rotatable member indexed to the piston, but rotatable relative thereto, to be part of a piston assembly in the housing between the inner and outer members, the rotation of the rotatable member to cause reciprocation of the piston relative to the rotatable member and thus, through the indexing, a variation in length of the piston assembly, a rotary drive, and a torque transmission from the rotary drive to rotate the rotatable member, to allow at least substantially longitudinal relative movement between the rotary drive and the rotatable member, and forming part of pathway for excitation caused by the variation in length of the piston assembly and any reciprocation of its mean positions relative to the housing.

In yet a further aspect the invention is an excitation device selectively operable to provide a downhole axial excitation, the device having, or to have, as part of a drillstring (whether of jointed drill rods or of continuous coil tube) a longitudinally extending housing with a axially extending casing and an inwardly spaced axially extending inner member (preferably tubular); the device being characterised in that the outer tube carries (e.g. via at least one thrust bearing) a selectively rotatable rotary drive assembly (e.g. of any of the kinds hereinafter mentioned);

and being further characterised in that there is within the casing, but about the inner member, an axially reciprocable assembly of (i) a piston or shuttle able to move longitudinally of, and within, the casing but not rotationally relative thereto, and (ii) a rotatable member indexed to cause the reciprocal axial movement relative to and/or of the piston or shuttle, yet move axially therewith despite its relative rotation to the piston or shuttle;

and being further characterised in that a longitudinally resilient torque transmission interposes the rotary drive assembly and the rotatable member whereby rotation of the rotary drive assembly can cause rotation of the rotatable member and this leads to longitudinal reciprocation of the axially reciprocal assembly.

Preferably the longitudinal reciprocation is in part caused by axial stretching and compressing of the torque transmission in operation responsive to camming interactions as a consequence of said indexing.

In another aspect the invention is a downhole excitation assembly to vibrate wholly, or in part as a consequence of axial reciprocation of a mass shuttle or piston including assembly ("piston assembly") responsive to a selective rotational input, the assembly comprising or including a housing of at least substantially axially extending inner and outer members, a mass, shuttle or piston ("piston") in the housing between the inner and outer members able to reciprocate in the axial direction yet held against any substantial rotation relative to one, or both, of said members, a tethered rotatable member indexed to be part of the piston assembly in the housing between the inner and outer members, each rotation of the rotatable member, at least in part, to cause at least one reciprocation, or multiple reciprocations, of the piston relative to the rotatable member and/or of the piston assembly, a rotary drive, and a torque transmission from the rotary drive to tether and to rotate the rotatable member and to allow at least substantially longitudinal relative movement, between the rotary drive and the rotatable member, the tethering being sufficiently spring-like to alternately provide a tensile return force and compressive separation force.

Preferably the transmission is tuned or tunable to allow resonant or near resonant force amplification or to disallow such amplification.

Preferably the rotatable member provides multiple reciprocations for each input rotation.

In another aspect the invention is a mechanical force generator comprising or including an elongate housing of at least substantially axially extending inner and outer members, a mass in the elongate housing between the inner and outer members able to reciprocate in the axial direction yet held against any substantial rotation relative to one, or both, of said members, a rotatable member indexed or otherwise interengaged ("indexed") to the mass between the inner and outer members, the rotation of the rotatable member relative to the mass able to vary the axial extent of that indexed assembly, a rotary drive, and a torque transmission spring (of any kind) from the rotary drive to rotate the rotatable member to allow at least substantially longitudinal relative movement, between the rotary drive and the rotatable member.

Preferably the mass/rotatable member indexing provides for a sliding association that allows relative rotation yet controls their relative axial positioning as an assembled unit.

Preferably the spring acts as a tether between the rotary drive and the rotatable member.

Optionally the device in operation has no impact percussions.

Preferably the mechanical force generator is of, or for, a drill string (e.g. whether jointed drill rods or continuous coil tube) to provide axial excitation.

Preferably the outer member is a tube or tubular casing.

Preferably the inner member is a tube.

Preferably the housing is at least substantially sealed to provide an elongate annular space in which the mass, rotatable member, rotary drive and torque transmission spring can cooperate.

Optionally each rotation of the rotary drive provides one or more reciprocation and/or axial excitation of the rotatable member and its indexed mass.

Preferably the rotatable member is provided with lobes.

Preferably the mass splines to the outer member.

Preferably both the mass and rotatable member are on bushes, bearings, runners or the like from the inner member.

Preferably the rotary drive is on a bearing or bush or the like from the inner member.

Preferably the rotary drive is on at least one thrust bearing from the outer member.

Preferably the excitation pathway is from the mass/rotatable member assembly as it varies in length and/or reciprocates via the torque transmission to the rotary drive and through into the outer member.

In another aspect the invention is a mechanical force generator comprising or including an elongate housing of at least substantially axially extending inner and outer members, a mass in the elongate housing between the inner and outer members able to reciprocate in the axial direction yet held against any substantial rotation relative to one, or both, of said members, a rotatable member cam or otherwise indexed or otherwise interengaged ("indexed") to the mass between the inner and outer members, the rotation of the rotatable member relative to the mass able to pulse by some multiple of the input rotations(s) of the rotatable member the axial extent of that indexed assembly i.e. preferably each rotation of the rotary drive provides one or more reciprocation and/or axial excitation of the rotatable member and its indexed mass, a rotary drive to provide directly or indirectly a rotational input to the rotatable member, and optionally, any one or more, or none, of the following:

a torque transmission spring (of any kind) from the rotary drive to rotate the rotatable member to allow at least substantially longitudinal relative movement, between the rotary drive and the rotatable member.

a spring (of any kind) from a drill rod, coil tube, or the like to the elongate housing from one end [e.g. proximally], and/or a spring (of any kind) to a drill rod, coil tube, tool or the like from the elongate housing from the other end [e.g. distally].

Preferably the mass/rotatable member indexing provides for a sliding association that allows relative rotation yet controls their relative axial positioning as an assembled unit.

Preferably the apparatus when in operation, has no impact percussions.

Preferably the apparatus is of or for a drill string (e.g. whether jointed drill rods or continuous coil tube) to provide axial excitation.

Preferably the outer member is a tube or tubular casing.

Preferably the inner member is a tube.

Preferably the housing is at least substantially sealed to provide an elongate annular space in which the mass, rotatable member, and rotary drive (and if present torque transmission spring) can cooperate as stated.

Preferably the rotatable member is provided with lobes or other means whereby each rotation of the rotary drive provides two or more cycles (e.g. reciprocations) as axial excitations.

Preferably the mass splines to the outer member.

Preferably both the mass and rotatable member are on bushes, bearings, runners or the like from the inner member.

Preferably the rotary drive is on a bearing or bush or the like from the inner member.

Preferably the rotary drive is on at least one thrust bearing from the outer member.

Preferably said spring acts as a tether between the rotary drive and the rotatable member.

Preferably the excitation pathway is from the mass/rotatable member assembly as it varies in length and/or reciprocates via the torque transmission to the rotary drive and through into the outer member.

Preferably there is a tethering torque transmission which is or includes a resonant spring.

Optionally there is no tethering spring and the rotatable masses are substantially of a non compliant nature.

Preferably there is provision of a fluid path through the apparatus.

Preferably an annulus (but not the fluid path) may, or may not, be filled with a non compressible fluid.

Preferably there is a vibration isolation member (spring/spline/air bag/or any other compliant member) either above or below to minimise unwanted vibration in either an up hole, or down hole direction.

Optionally any vibrational off take is either in an up hole or downhole direction, or both.

Preferably the output power/force can be manipulated by controlling the input drive RPM, (whether by fluid flow or other means).

Preferably the apparatus is used in a drill string.

Preferably it is used in conjunction with diverter valves, (whether fluid or gas, etc) which can be used to engage/disengage the input drive.

Preferably the, or a compliant member (s), spring, etc, is used within the assembly.

Preferably the invention is an apparatus, a device or a generator as previously defined whereby the device can be positioned either above, below, or both above, and below the rotational power source.

Optionally, and preferably, the apparatus, device or generator when in use, or adapted for use, can be used in conjunction with one or more of the following downhole applications:

shifting valves
setting plugs
setting screens
sand control in screens
milling
scale removal
cementing
core sampling
drilling
fishing for stuck tools
used in wire line applications Preferably the power source has a dual rotational output thereby enabling the vibrational device to be located above the rotational power source and some other tool (e.g. a drill bit/milling tool etc) to be located below the power source.

As used herein "tether" and variations of it merely means holding together.

As used herein "rotatable" refers in the case of the rotatable member only to its ability to rotate relative to the mass with which it is interengaged or indexed. It should be appreciated, as part of a drill string, the overall device can itself by rotatable.

As used herein the term "piston" can include any mass to cycle along the axis on which the rotatable member rotates. The term "piston" does not require, nor rule out, any inferred consequential gaseous compression.

The "spring" can be a tubular spring (e.g. of concertinaeble titanium) or other. It can be a unitary member or a coacting collection of members. It can be skeletal or non-skeletal. It may be of a rubber a synthetic, an air spring, or any other compliant member that fulfils the requirement.

As used herein the term "(s)" following a noun means one or both of the singular or plural forms.

As used herein the term "and/or" means "and" or "or". In some circumstances it can mean both.

BRIEF DESCRIPTION OF THE DRAWINGS

Preferred forms of the present invention will now be described with reference to the accompany drawings in which FIG. 1 [with different conditions above and below the centreline ("CL") being shown as if FIGS. 1A and 1B respectively] of an embodiment of apparatus of the present invention, FIG. 1A showing a condition of maximum displacement of the reciprocable mass/piston on the tension stroke and FIG. 1B showing a condition of maximum displacement of the mass/piston on the compression stroke (e.g. at 180° position)

DETAILED DESCRIPTION OF THE INVENTION

Figures 1A, 1B:
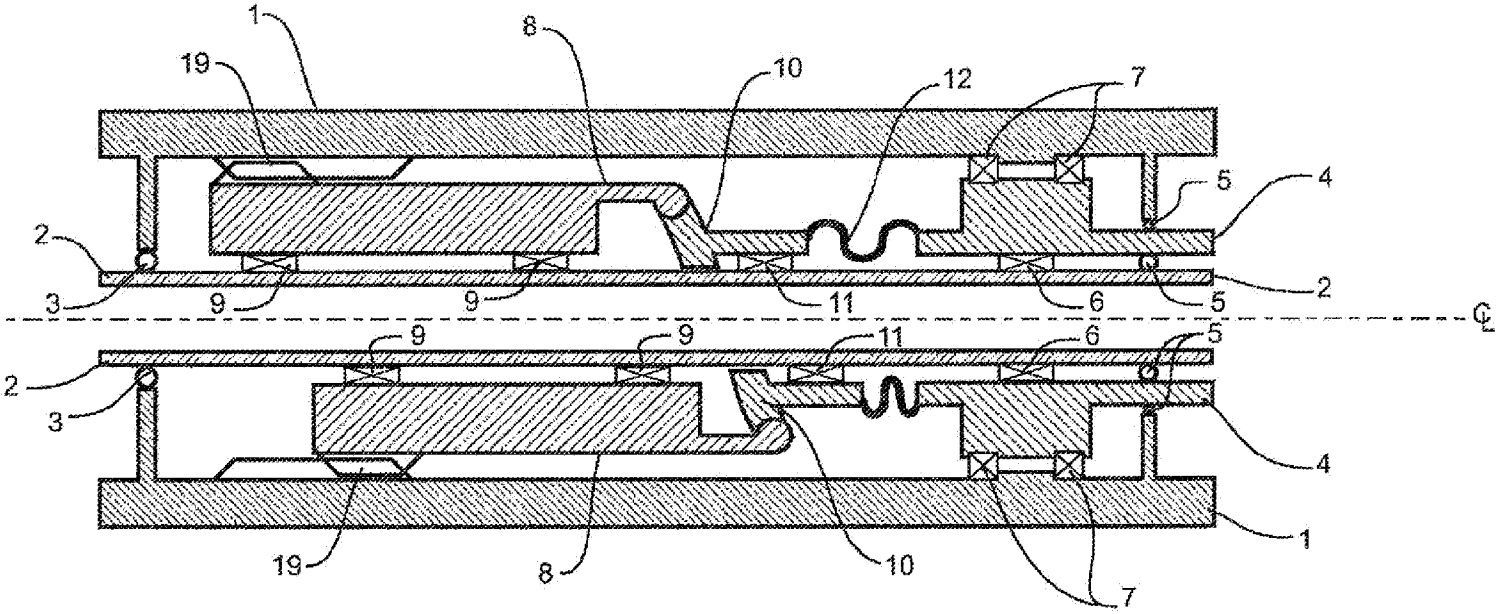

Shown in FIG. 1 (and parts thereof 1A and 1B) is an external tube or casing 1 and an internal tube 2. An annular environment is sealed reliant upon O-ring or other seal types 3 and 5 respectively between 1 and 2 and amongst 1, 4 and 2.

The shuttle assembly comprises the mass, shuttle or piston 8 and the indexed rotatable member (also a mass) 10. Bushes 9 and 11 allow the shuttle assembly (8 and 10) to move axially of the tubes 1 and 2 with the spline arrangement 19 tying the mass, shuttle or piston 8 against rotation relative to the casing 1.

The rotation of the rotatable member 10 arises from a drive shaft or other input drive 4 (e.g. a PDM motor driven drive shaft 4 or other as described hereinafter). This drive shaft 4 slides on a bush 6 and is held by thrust bearings (preferably a coacting pair of thrust bearings) 7 to the tube or casing 1. This is to provide an outflow path for excitation energy to provide axial excitation of the tube or casing 1.

The input drive 4 connects via a compressible/extendible spring 12 able to transmit torque from the member 4 to the rotatable member 10.

As can be seen, the effect of rotation of the member 10 relative to the member 8 which is held rotationally stationary with respect to the tube 1 (irrespective of whether or not tube 1 moves with the drillstring or not), has the effect of providing reactive forces between the mass 8 and the mass of the rotatable member 10 tethered by the torque transmitting spring arrangement 12. This also varies length of the subassembly of 8 and 10.

Different facets of its mode of operation arise depending on the RPM relationship of the input drive via 4 into the torque transmission spring 12 and from thence into the various states of the shuttleable shuttle assembly 8/10, and vice versa. Some states will be preliminary to a near or at resonant arrangement for which it is possible to tune the system.

The inner and outer tubes are non-rotating or together can rotate with the drillstring.

The drive shaft (e.g. 4 as the input drive) from preferably (but not necessarily) a PDM rotates a wobble plate 13 via a spring 12 that is tuned for a particular resonant frequency. The wobble plate converts the drive shaft rotational motion to axial simple harmonic motion of the reciprocating piston or mass 8. If the wobble plate has four lobes the reciprocating piston 8 strokes four times for every rotation of the driving shaft 4.

The acceleration and deceleration of the piston 8 creates an axial force that transmits from the rotary member 10 through the spring 12 and axial thrust bearings 7 into the outer coil tube 1.

The speed of the input shaft 4 has to be well controlled to appropriately manage the force magnification factor near resonant conditions.

The use of a multi lobe wobble plate 13 of the rotatable member 10 and the resonant spring 12 allows high frequencies and high vibrating axial forces to be obtained in the small space available down hole.

The input to shaft 4 could be a PDM, turbine, mechanical drive, electrical or other downhole device.

Figure 2:
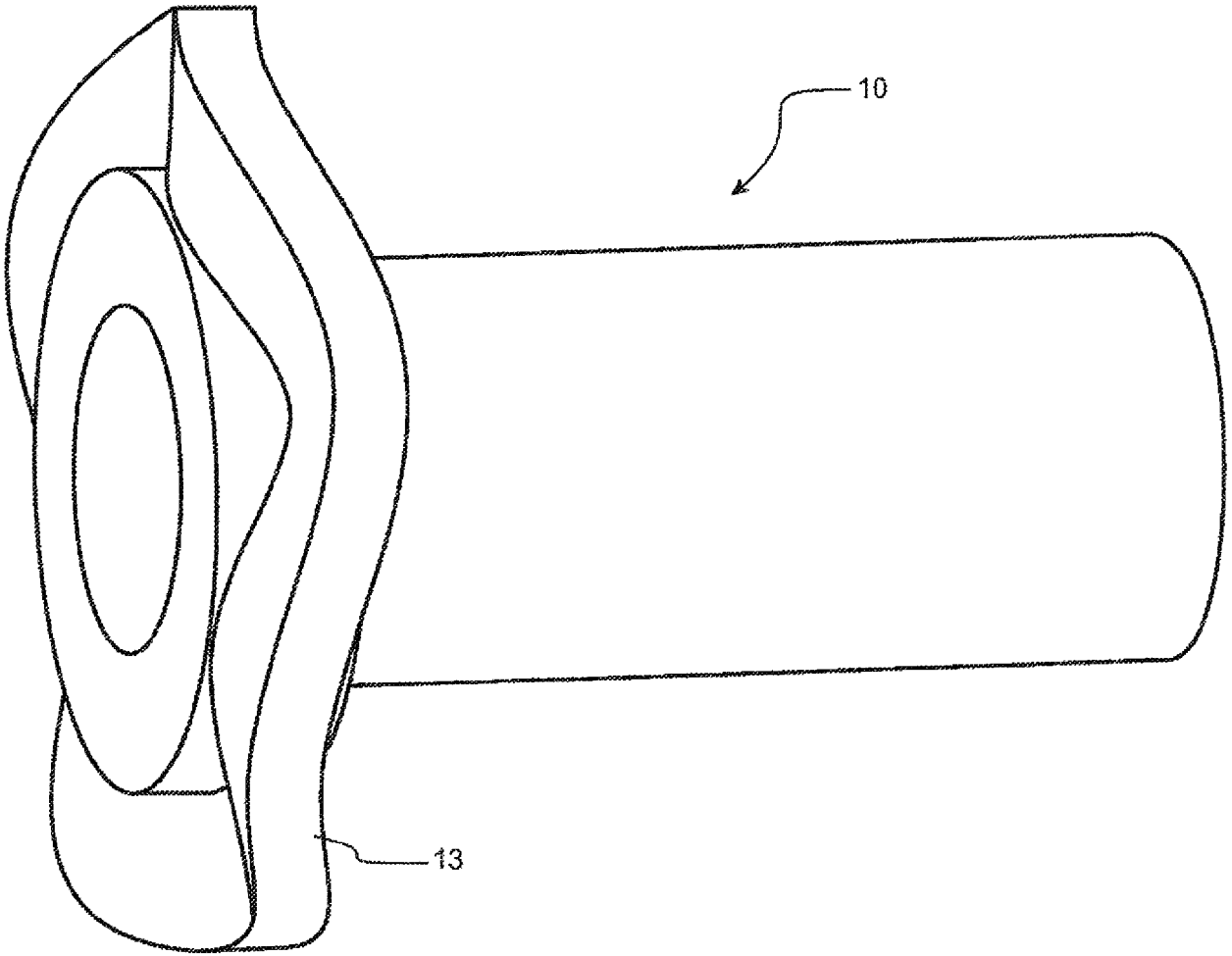
FIG. 2 shows, by way of example, a four lobe wobble plate as suitable as part of the rotatable member to act as a four lobed cam or cam follower (it does not matter which as long as it is complementary to the mass to which it is to interengage with)

FIG. 2 shows a rotary member 10 as a sleeve carrying a wobble plate or multilobed cam-like form 13 (a four lobed version being shown). It acts much like a cam or cam follower to a cam follower or cam respectively in suitable sliding engagement options. One such option is shown in FIG. 1.

The energising multi lobbed wobble plate used to oscillate the shuttle, could also be a crank/conrod design, or any other mechanical, or hydraulic connection that (pushes and pulls) takes the rotary action from the input drive (PDM etc) and transmits this into an axial movement. These axial movements, as a pulse, are preferably plural for each input rotation.

In FIG. 1 it can be seen that the multilobed wobble plate 10 rotates responsive to rotating input shaft 4 (for example a PDM). FIG. 1A shows the rotating input shaft, for example, at a zero degrees position whilst FIG. 1B shows that shaft at a 180 degrees position.

Preferably the transmission is via a tuned spring rotating in unison with the wobble plate 10 responsive to the input of the input shaft 4. This spring 12 is tuned to the tensile/compressive limits shown.

Also shown in FIG. 1, as a flow diagram, drilling fluid can be caused to pass through the passageway provided by the inner tube 2. Tube 2 need not be a rotating tube and preferably is non rotating.

Figure 3:
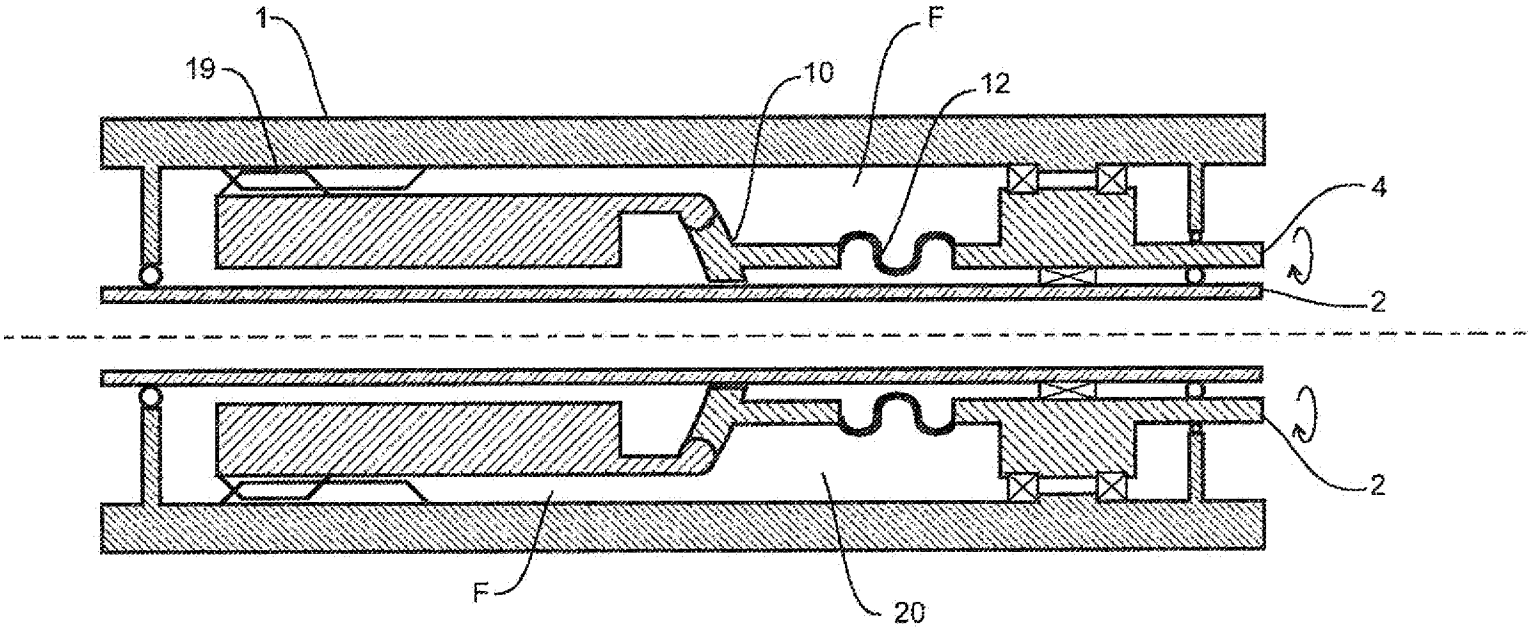
FIG. 3 shows for an embodiment substantially as in FIG. 1A a fluid filled option with an uninterrupted drilling mud pathway internally of the inner tube and indicating an optional fluid presence 'F' in the environment bounded by the seals and bearings internally of the outer tube.

The optionally fluid 'F' filled configuration of FIG. 3 is similar to that shown in FIG. 1. However in this configuration the internal cavities (e.g. annulus 20) may be fluid filled—possibly with a light oil or the like as some type of pressure compensation device. This is in addition to any flow through drilling mud as shown.

This will help avoid high pressure differential sealing issues when the tool is required to operate in deep holes with high hydrostatic pressures.

Figure 4:
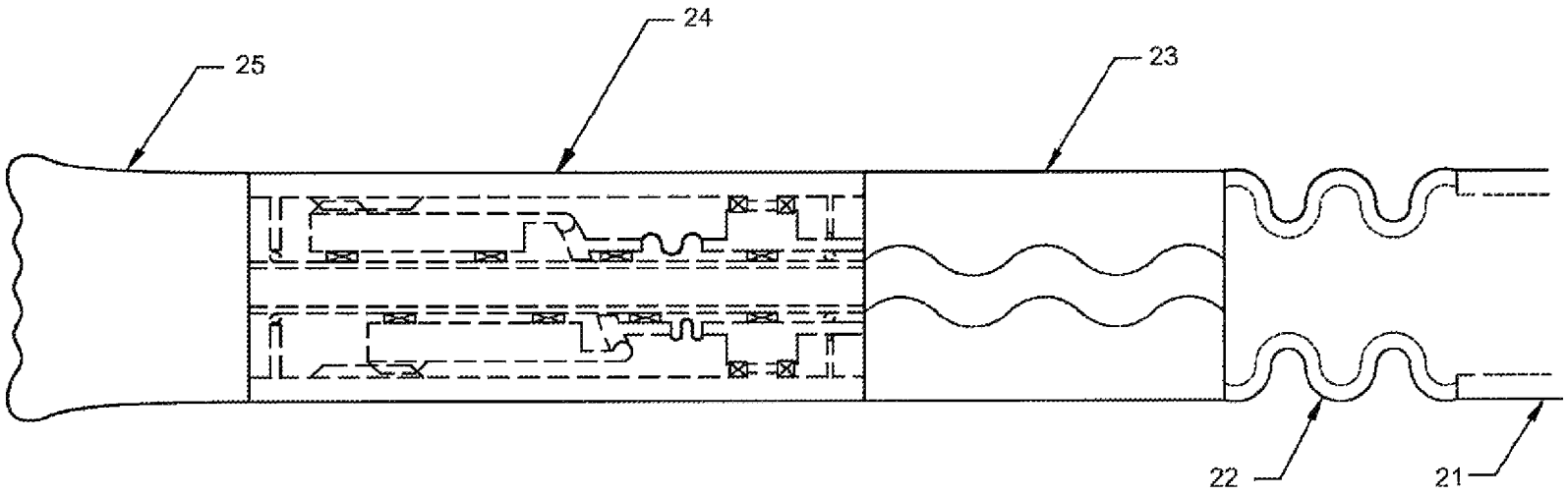
FIG. 4 shows a straight drill head assembly including apparatus of, for example, FIG. 1 or FIG. 3.

In FIG. 4 there is shown a drill pipe 21, (which can cause the entire assembly to rotate when manipulated to do so—allowing the drill bit to advance into the formation being drilled) a spring or spline (or both) 22, a PDM or similar motor 23, a mechanical force oscillator or generator substantially of any of the kinds herein described 24, and a drill bit or coring bit 25. In this configuration, the addition of the compliant member 22 allows the entire assembly to oscillate back and forth, to enable the device to be used as an impact hammer to the drill bit or coring device 25, while (somewhat) protecting the internals of the device from the shock loads uphole or to any devices above the spring or spline.

Figure 5:
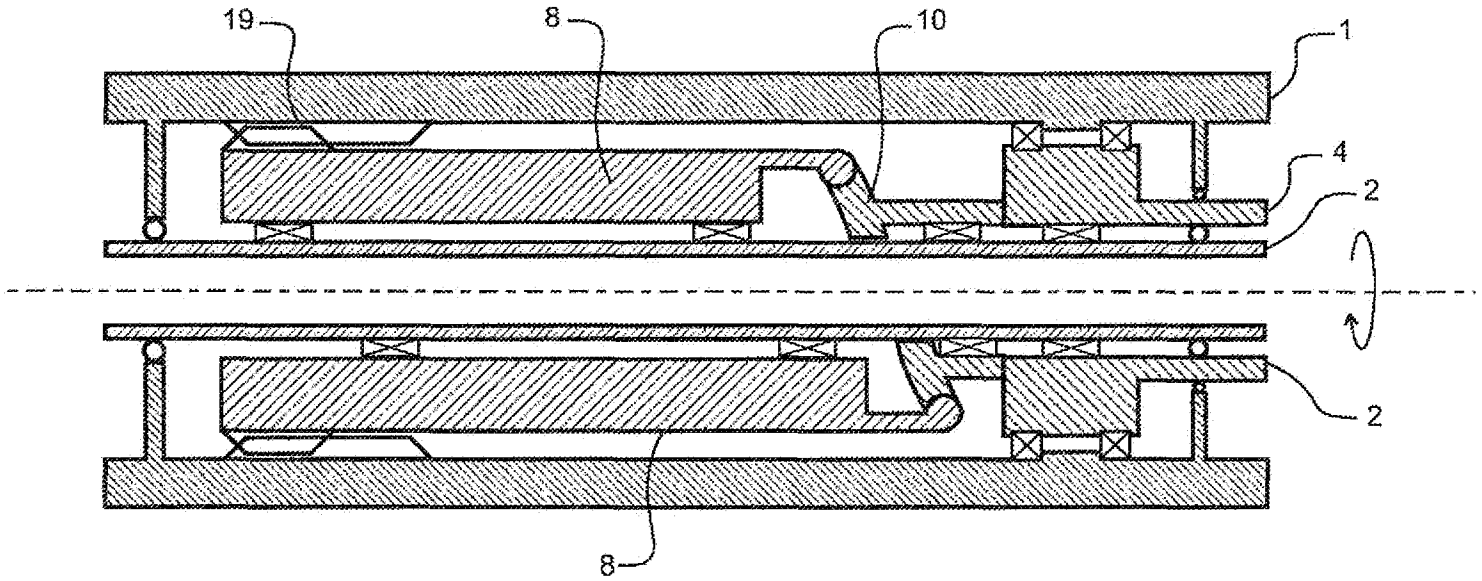
FIG. 5 shows an embodiment of the invention in the manner shown in FIG. 1 (and FIGS. 1A and 1B) where no spring is interposing the rotating input shaft and the multi-lobed wobble plate to rotate with the input shaft.

The device of FIG. 5 is similar to that shown in FIG. 1. However in this configuration there is no compliant member 12 between the wobble plate 10 and the rotating shaft input 4. This device could be used where adequate axial force can be generated without needing to get the tool into a resonant condition.

Figure 6:
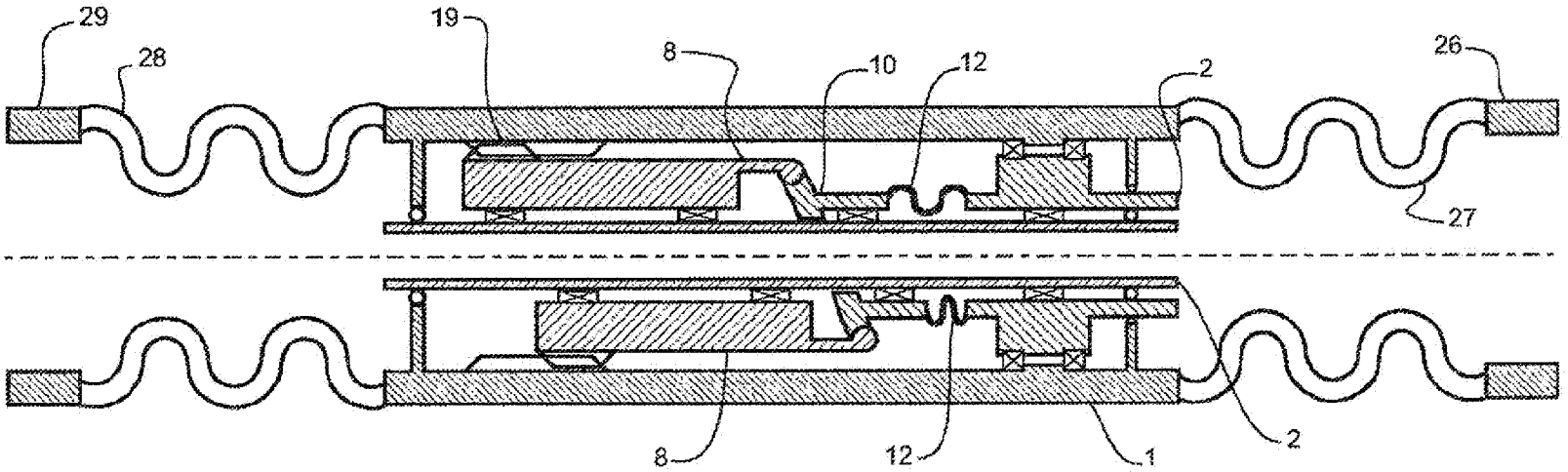
FIG. 6 shows in the manner or FIG. 1 an embodiment where, additionally, the apparatus of the invention is spline, spring or both connected via the outer tube into the drill string (e.g. in each instance to a drill rod, coil tube, or the like)

FIG. 6 shows an arrangement as in FIG. 1 where both proximally and distally there is a spline, spring 27, 28 or both linking to and from the outer casing. In some situations a spring/spline (or both) may be used either above or below the tool (or both) to isolate any unwanted shocks from damaging delicate equipment. This configuration could be useful when the tool is used as a seismic source generator.

Whilst the arrangement as in FIG. 6 is substantially as shown FIG. 1, equally it could be the arrangement without the tethering spring 12 (e.g. of for example FIG. 5).

Shown is, for example, a drill rod, coil tube, or the like 26 that drives via the spline, spring, etc 27 to the casing or outer coil tube. Likewise there can be a spline, spring or the like 28 connecting to a more distal rod, coil, tool or the like 29.

Figure 7:
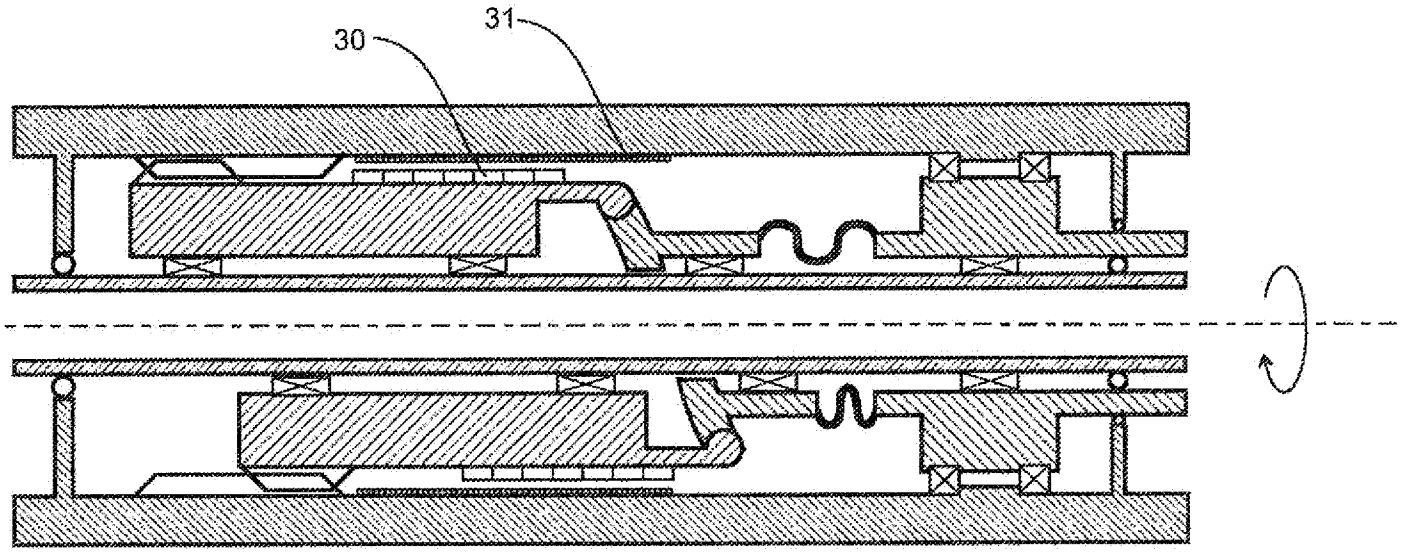
FIG. 7 shows an adaption of apparatus substantially in FIG. 1 (including FIG. 1A and FIG. 1B modes) being used also to generate electricity downhole.

The device of FIG. 7 is similar to that shown in FIG. 1. However magnets 30 (preferably rare earth) are positioned on the reciprocating piston and electrical windings 31 are positioned adjacent to these magnets—so that as the piston oscillates electrical power may be generated. This arrangement can be very useful to power any number of downhole tools. Of course the position of the magnets and windings can be changed to any configuration that achieves this objective.

Figure 8:
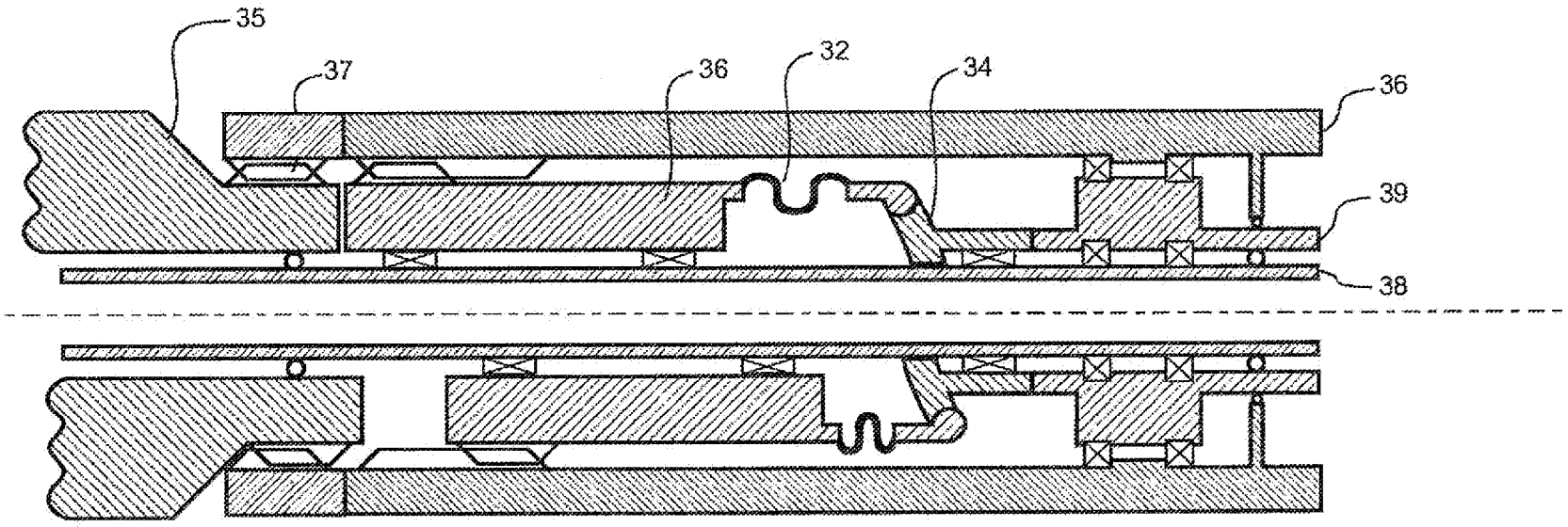
FIG. 8 shows a force generator hammer device.

The device of FIG. 8 is similar to that shown in FIG. 1. However this device has the compliant member (spring etc) 32 between the wobble plate 34 and the oscillating piston or mass 33 the piston then impacts against the drill bit 35 (or other—drill rod etc) which is splined at 37 to the outer body 36 (and rotated by the outer body—via the drill rods at surface) generating a hammer action.

Shown also is an inner tube 38 and the rotating input shaft 39 (e.g. from a PDM).

In this application the compliant member (spring) protects the wobble plate—bearings etc from harmful shock waves. Of course the placement of the compliant member (spring etc) can be placed anywhere within the system that helps reduce damaging shock waves.

Figure 9A:
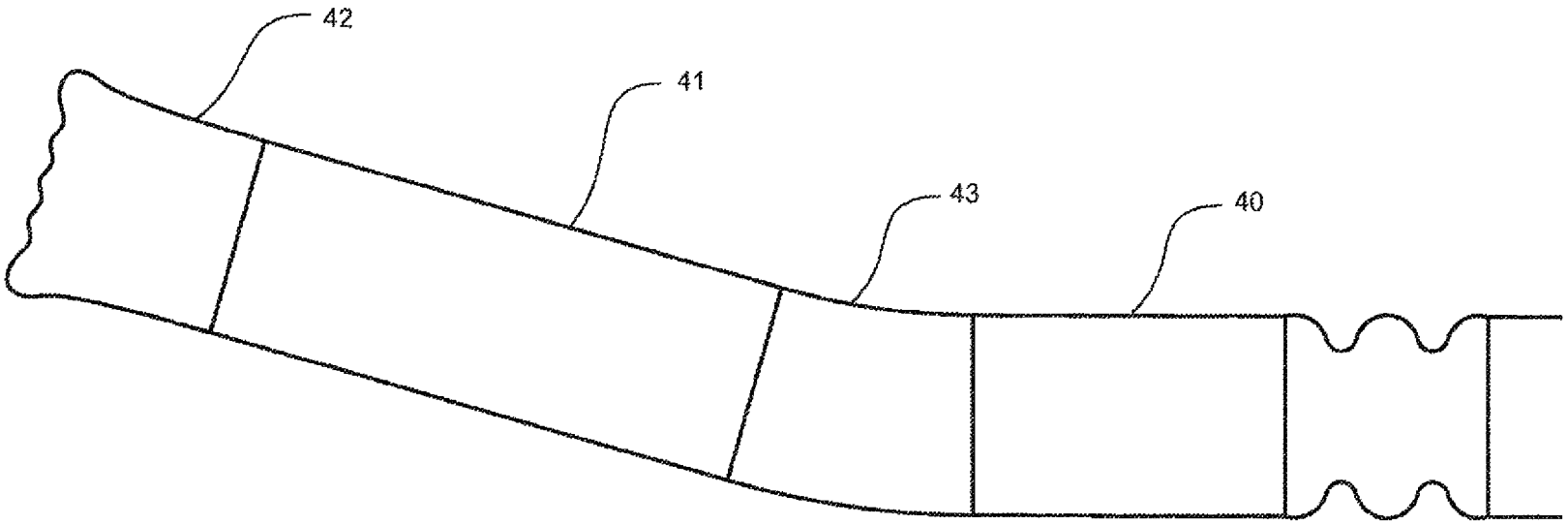
FIG. 9A shows a bent sub including steering drill head assembly.
Figure 9B:
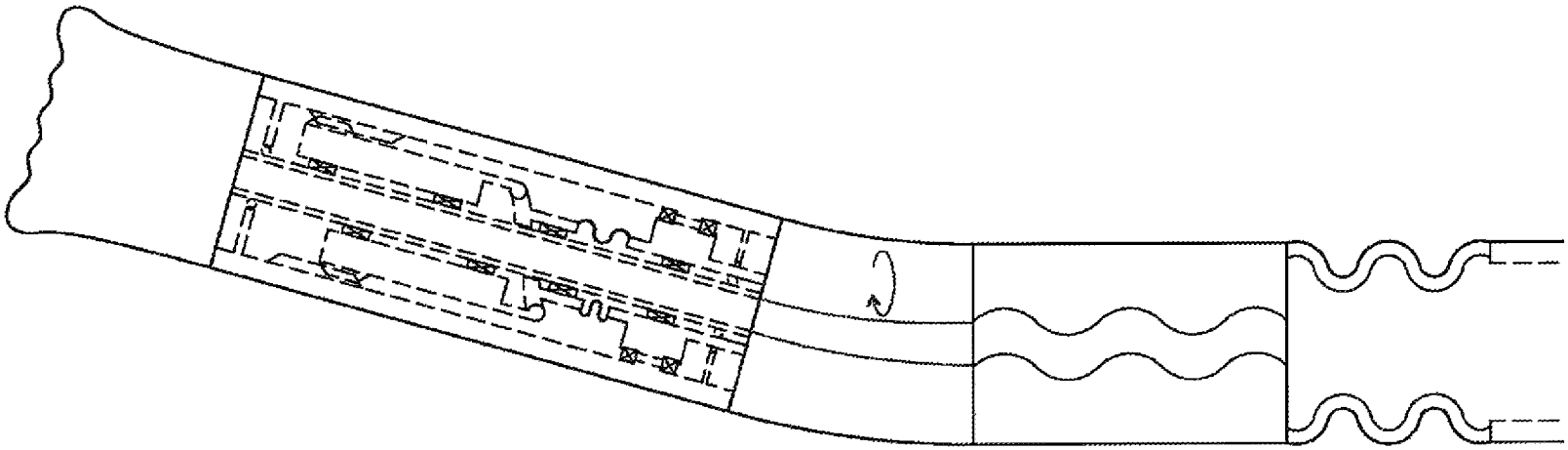
FIG. 9B shows some internals of the bent sub [e.g. an offset bearing pack and flexishaft or similar torque transmitter between an embodiment of FIG. 1A/1B and a PDM).

This type of device can also be steered in a manner similar to FIG. 6 or 9A/9B.

The device of FIG. 9A/9B is similar to FIG. 6. However there is the addition of a bent sub 43 between the PDM or similar 40 and the mechanical force generator 41. The bent sub 43 allows for straight drilling by having the entire assembly rotated from the surface (by the drill rig) while the oscillator 41 transfers vibrations to the drill bit 42 helping to facilitate forward drilling progress—albeit with a slightly over gauge hole (due to the bent sub).

When the assembly needs to be steered in a new direction, the drill bit is pointed in the desired direction without the outer body rotating. However the rotary input shaft that rotates the wobble plate in the mechanical oscillator—also continues through the centre of the tool and provides rotation to the drill bit (and fluid to the drill bit) while the oscillator transfers vibrations to the drill bit—thus allowing a steered bore to be advanced through the formation.

Steering with the bent sub could also be done but with the oscillator configured to operate as an impact hammer as shown in FIG. 8.

The invention claimed is:

1. Apparatus to operate as a mechanical force generator with an at least near sinusoidal output or as a mechanical excitation device with an at least near sinusoidal output, the apparatus having a longitudinal axis and comprising or including:

an elongate inner member axially aligned to the longitudinal axis, a mass disposed about the inner member and able to reciprocate relative thereto in the longitudinal direction, an outer member about at least part of the mass and about at least part of the inner member and in respect of which the mass can move axially in the longitudinal direction yet is constrained from any substantial rotation relative to the outer member about the longitudinal axis, a rotatable member able to rotate about the longitudinal axis and directly and/or indirectly upon its rotation to cause axial reciprocation of the mass relative to said outer member, and a rotary drive to provide directly or indirectly a rotational input to the rotatable member;

wherein without impacts or impacts of significance there is an output pathway from the mass into the outer member.

2. Apparatus of claim 1 wherein the mass and rotatable member interact whereby more than one reciprocation occurs for each rotation of the rotatable member.

3. Apparatus of claim 1 wherein there is an interposed spring between the rotary drive and the rotatable member is able to transmit torque yet allow a relativity of axial movement.

4. Apparatus of claim 1 wherein a spring whether as a tether or otherwise prevents impacts or impacts of significance.

5. Apparatus of claim 1 wherein the output pathway is via an abutment.

6. Apparatus of claim 1 wherein the output pathway is via a thrust bearing.

7. Apparatus of claim 1 wherein the inner member is tubular and is to provide a fluid pathway.

8. Apparatus of claim 1 wherein the mass and rotatable member have a cam/cam follower relationship or vice versa.

9. Apparatus of claim 1 wherein the mass and rotatable member have a wobble plate interaction.

10. Apparatus of claim 1 when in a drill string or as part of a drill string.

11. Apparatus with a longitudinal axis to operate as a mechanical force generator or a mechanical excitation device, the apparatus comprising or including an elongate housing of at least substantially axially extending inner and outer members, a mass in the elongate housing between the inner and outer members able to reciprocate in the axial direction yet held against any substantial rotation relative to one, or both, of said members, a rotatable member between the inner and outer members engaging the mass so that in use the rotation of the rotatable member relative to the mass is able by some multiple of the input rotation(s) of the rotatable member to axially excite both the rotatable member and the mass, and a rotary drive in respect of which the rotatable member can reciprocate axially a rotational input to the rotatable member, wherein an output pathway is provided from the mass into the outer member for a sinusoidal or near sinusoidal output without any substantial impacts.

12. Apparatus of claim 11 wherein a spring whether as a tether or otherwise controls movement of the mass axially.

13. Apparatus of claim 12 wherein the spring is a torque transmitter between the rotary drive and said rotatable member.

14. Apparatus to act as a mechanical force generator or as a mechanical excitation device, the apparatus comprising or including an elongate housing of at least substantially longitudinally extending inner and outer members, the outer member being a tube, a mass in the elongate housing about the inner member and being between the inner and outer members, the mass being able to reciprocate in the longitudinal direction yet held against any substantial rotation relative to one, or both, of said members, a rotatable member indexed to the mass but rotatable relative thereto, to be part of a variable lengthened assembly of the mass and rotatable member in the housing between the inner and outer members, the rotation of the rotatable member to cause at least two reciprocations of the mass relative to the rotatable member and thus, through the indexing, a variation in length of the variable lengthened assembly, a rotary drive, and a torque transmission from the rotary drive to rotate the rotatable member, to allow at least substantially longitudinal relative movement between the rotary drive and the rotatable member, and forming part of the pathway for excitation caused by the variation in the length of the variable lengthened assembly and any thereof reciprocation of its mean positions relative to the housing;

wherein there is an output pathway from the mass into the outer member and the output force or excitation is a sinusoidal or near sinusoidal output as a consequence of the variable lengthened assembly not making any substantial impacts.

15. Apparatus of claim 14 wherein the torque transmission is by way of a spring tether.

* * * * *